United States Patent [19]

Lemke

[11] Patent Number: 4,507,991

[45] Date of Patent: Apr. 2, 1985

[54] APPARATUS FOR INSTALLING FASTENERS

[76] Inventor: Stuart H. Lemke, Rte. 2, Box 288C, Mukwonago, Wis. 53149

[21] Appl. No.: 479,456

[22] Filed: Mar. 28, 1983

[51] Int. Cl.[3] ..... B25B 19/00

[52] U.S. Cl. ..... 81/463; 81/464; 81/57.44

[58] Field of Search ..... 81/463, 464, 465, 466, 81/55, 57.44; 173/105; 29/240

[56] References Cited

U.S. PATENT DOCUMENTS

| | | | |
|---|---|---|---|
| 2,929,134 | 3/1960 | Mosher | 29/240 |
| 3,323,394 | 6/1967 | Bangerter et al. | 81/464 |
| 3,323,395 | 6/1967 | Burnett et al. | 81/55 |
| 3,403,738 | 10/1968 | Burkhart et al. | 173/105 |
| 3,479,714 | 11/1969 | Allsop | 29/240 |
| 4,368,784 | 1/1983 | Wunsch et al. | 81/464 |

*Primary Examiner*—James L. Jones, Jr.

*Attorney, Agent, or Firm*—Andrus, Sceales, Starke & Sawall

[57] ABSTRACT

A tool for installing fastening devices includes a casing having a handle portion, a body portion and a tip portion. A rotatable socket at the tip portion engages the fastener and screws it into the materials to be joined. A barb assembly engaging rod disposed within the casing is then extended out through the tip portion of the tool and depending on the type of fastener being used provides either impact or rotational motion to a plunger disposed within the fastener.

10 Claims, 5 Drawing Figures

APPARATUS FOR INSTALLING FASTENERS

CROSS REFERENCE TO RELATED APPLICATION

A portion of the disclosure in this application is also disclosed and/or claimed in the following pending application:

Ser. No. 414,932 filed Sept. 3, 1982 in the same of Stuart H. Lemke and entitled "Fastening Device".

BACKGROUND OF THE INVENTION

The present invention relates to a tool for installing fasteners, and more particularly to a tool for installing a particular fastener that is used to join layers of roofing material.

The development of a fastener for joining layers of insulation to a light weight deck or for joining two layers of insulation, such as the fastener disclosed in this application and the fastener disclosed in the above mentioned application, required the development of a special tool for the installation of fasteners of this type.

The fasteners include an externally threaded elongated member terminating in a tip and an internal channel which may or may not also be threaded and which contains a flexible barb and its associated plunger member. Thus, it is necessary that a tool for installing fasteners of this type be capable of providing rotational motion to the fastener itself so that it may be screwed into the material. The tool must also be capable of engaging the plunger and causing its downward movement so that the barb may be forced from the internal channel in the fastener.

The fasteners themselves may take on two different embodiments. The fastener may be of the type shown in the above mentioned patent application wherein the plunger is merely slidably contained within the channel or the fastener may be of the type as disclosed in this application in which the channel itself is threaded and the plunger includes threads that mesh with the threads of the channel so that rotational motion of the plunger results in longitudinal motion of the plunger toward the tip of the fastener. It is also possible to utilize a non-threaded channel containing a self tapping plunger assembly that upon rotating accomplishes the same results.

Therefore, in order for the tool to be operable with both types of fasteners it is necessary for the tool to be capable not only of imparting a downward motion to a slidable plunger but also be capable of imparting a rotational motion to a threaded or self tapping plunger.

Tools such as that shown in U.S. Pat. No. 3,479,714 to Allsop provide rotational motion to a nut and then deliver an impact to the nut. While impact wrenches such as the Blue Point AT300A power impact wrench manufactured by Snap-On Tools merely provide rotational motion to the fastener.

It is the object of the present invention to provide a tool for installing fasteners of the type discussed above which will impart a rotational motion to the fastener and also provide either an impact to the plunger within the fastener or a rotational motion to the plunger depending on the type of fastener being used.

SUMMARY OF THE INVENTION

An apparatus for installing a unique fastener includes a casing having a handle portion, a body portion and a tip portion.

A socket disposed adjacent the tip portion engages the head of the fastener. The tool then rotates the socket in order to screw the fastener into position.

In accordance with another aspect of the invention a barb assembly engaging rod is disposed within the casing and is movable between a retracted position and an extended position. At the extended position the rod engages a barb assembly disposed within an internal channel in the fastener and forces the barb downwardly and out through sidewall openings in the tip of the fastener.

A piston slidably mounted in the casing is utilized to move the rod between its retracted and extended positions.

In accordance with yet another aspect of the invention a spring is disposed within the casing to bias the piston to its non-stroked position and in turn to bias the rod to its retracted position.

In accordance with yet another aspect of the invention the barb assembly engaging rod is slidably disposed within the motor that is utilized to provide rotating motion to the socket so that the rod is free to move between its extended and retracted position. However, rotational motion of the motor results in a corresponding rotational motion of the anvil which causes the rotation of the barb assembly engaging rod.

The tool is also provided with trigger mechanisms that allow selective operation of the rotating socket, the extension and retraction of the barb assembly engaging rod and rotation of the rod.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
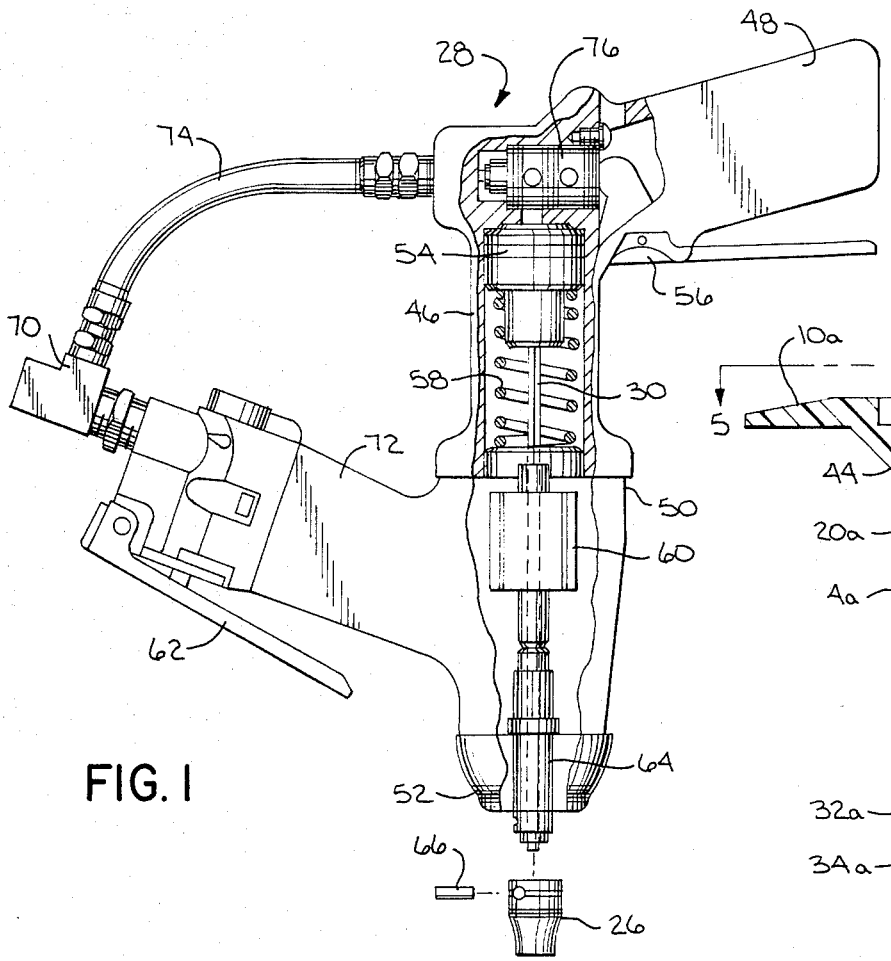
FIG. 1 is a side view with parts broken away of a tool for installing fasteners constructed according to the invention.
Figure 3:
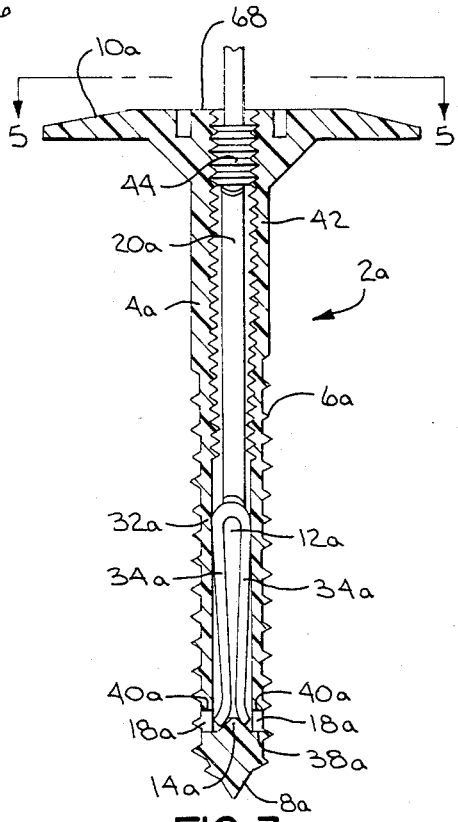
FIG. 3 is a cross sectional view of yet another type of fastener which is installed by the tool of FIG. 1.
Figure 4:
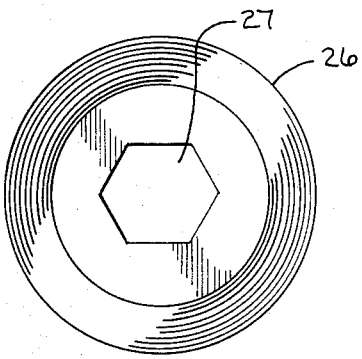
FIG. 4 is an end view of the socket at the tip of the tool of FIG. 1.
Figure 5:
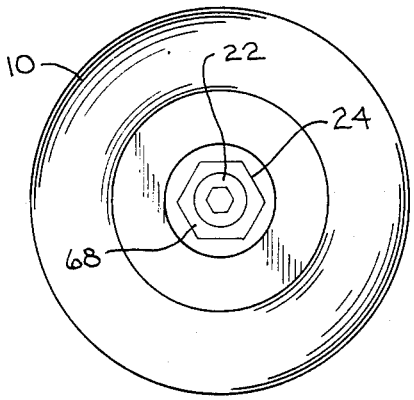
FIG. 5 is a section taken along the line 5—5 of FIG. 3.
Figure 2:
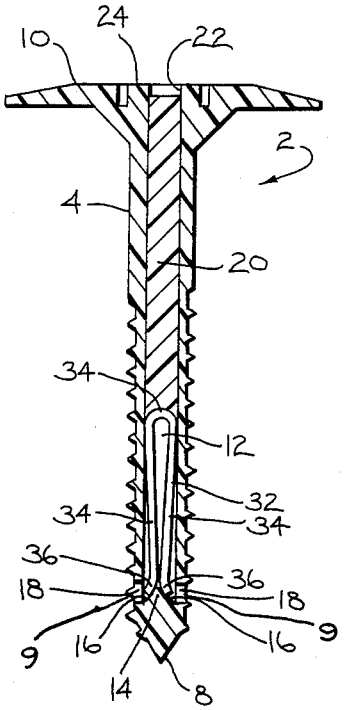
FIG. 2 is a cross sectional view of the type of fastener installed by the tool of FIG. 1.

FIG. 1 illustrates a specialized tool developed specifically for the installation of fasteners such as those shown in FIGS. 2 and 3. The unique configuration and operation of the fasteners requires a specially adapted tool for their installation.

As shown in FIG. 2, fastener 2 includes an elongated member 4 having external screw threads 6 and terminating in a pointed tip 8 at one end and in a flange like head 10 at the other end.

Elongated member 4 has an internal channel 12 running substantially the entire length of member 4 and terminating at one end in an opening in head 10 and terminating at the other end in a double faced ramp 14 located near the tip 8 of member 4.

Ramp 14 has a pair of faces 16 that extend outwardly and downwardly toward a pair of sidewall openings 18 in member 4.

A plunger 20 is disposed for longitudinal movement within channel 12 and communicates with an opening 22 in head 10. Opening 22 is disposed within a hexagonal protrusion 24 located within a recess in flange like head 10. Protrusion 24 provides a tool engaging surface that mates with socket 26 on tool 28 during the installation of fastener 2. Protrusion 24 also serves to position and locate a rod 30 that engages plunger 20 through opening 22.

A U-shaped wire member 32 is also disposed for longitudinal movement within channel 12 and has its base portion 34 in engagement with the bottom surface of plunger 20. The legs 34 of U-shaped member 32 form a pair of flexible barbs having outwardly flaired ends 36 that engage faces 16 of ramp 14.

Each of sidewall openings 18 is provided with a barb directing surface 38 formed by a flat in the lower portion of opening 18. Barb directing surface 38 engages end 36 of leg 34 and guides legs 34 in a direction substantially perpendicular to the longitudinal axis of channel 12.

Openings 18 are also provided with a barb engaging surface 40 that causes a frictional drag on leg 34 as it exits opening 18 and thus causes leg 34 to curl as it exits opening 18.

Fastener 2 is best suited for the joining of insulation to light weight decks such as tectum decks. However, it has come to the applicants attention that when fastener 2 is utilized on heavier decks such as light weight concrete the impact of rod 30 on plunger 20 causes an undesirable shock or kickback on the tool. Therefore, an alternate embodiment, shown in FIG. 3, was developed for use of the fastener in light weight concrete decks.

As is shown in FIG. 3, fastener 2*a* also includes an elongated member 4*a* having external screw threads 6*a* and terminating in a pointed tip 8*a* at one end and in a flange like head 10*a* at the other end.

Similarly, tip 8*a* is provided with corresponding sidewall openings 18*a*, barb directing surfaces 38*a* and barb engaging surfaces 40*a*.

Elongated member 4*a* is also provided with an internal channel 12*a* that runs substantially the entire length of member 4*a* and terminates at one end in an opening in head 10*a* and terminates at the other end in a double faced ramp 14*a*.

The upper half of internal channel 12*a* is provided with screw threads 42 and plunger member 20*a* is provided with a hexagonal opening and with mating screw threads 44. However, it is also possible to utilize a smooth walled channel 12*a* in combination with a self tapping plunger member 20*a* having a hexagonal opening. Thus, during installation rod 30 is utilized to provide rotational movement to plunger 20*a* rather than mere impact. The rotational motion of plunger 20*a* results in a smooth longitudinal motion of plunger 20*a* towards the tip 8*a* of fastener 2*a*. Thus, the legs 34*a* of U-shaped member 32*a* are forced out sidewall openings 18*a* at tip 8*a*.

The two forms of fastener 2 and 2*a* require the development of a tool which can insert the fastener and also provide either an impact to plunger 20 or a rotational motion to plunger 20*a*.

A tool capable of providing the necessary operations is illustrated in FIG. 1.

Tool 28 consists of a casing 46 having a handle portion 48, a body portion 50 and a tip portion 52.

Disposed within body portion 50 is piston 54 that is operable by piston trigger 56. Piston 54 is utilized to move rod 30 between its retracted position (as shown in FIG. 1) and its extended position. At its extended position rod 30 engages either plunger 20 or 22*a* depending on the type of fastener being used.

A spring 58 is utilized to bias piston 54 to its non-stroked position so that rod 30 is normally in its retracted position.

Also disposed within body portion 50 is air motor 60 that is operable by motor trigger 62. Rod 30 is slidably contained within air motor 60 and rod 30 is hexagonal and mates with a hexagonal bore in air motor 60 so that while longitudinal movement of rod 30 is allowed, rotational movement of air motor 60 causes rotational movement of rod 30.

Rotational movement of air motor 60 results in rotational movement of anvil 64 which in turn causes rotational movement of socket 26 which is connected to anvil 64 by means of rollpin 66.

Socket 26 is provided with a 6 point opening 27 in order to fit the hex top 68 on fasteners 2 and 2*a*. When used to install either fastener 2 or 2*a* the sprocket 26 of tool 28 is placed on the hex top 68 and motor trigger 62 is depressed. This causes compressed air from a source (not shown) to pass through coupling 70 and handle portion 72 and engage the vanes on air motor 60 resulting in rotation of the air motor. This causes rotation of socket 26 and fastener 2 or 2*a* is screwed into the materials to be joined.

The continued operation of tool 28 then depends on the type of fastener being utilized i.e., fastener 2 or fastener 2*a*.

When utilized with fastener 2, motor trigger 62 is then released and piston trigger 56 is depressed. This causes compressed air to travel through coupling 70, connecting hose 74, and valve 76 so that it finally actuates piston 54, moving piston 54 to its stroked position and rod 30 to its extended position where it impacts plunger 20 and forces barb 32 out through sidewall openings 18.

When utilized with fastener 2*a*, the fastener is screwed into the material as described above. However, at this point, motor trigger 62 is released and piston trigger 56 is then depressed in order to move rod 30 to its extended position. Then with piston trigger 56 still depressed, so that hex rod 30 is in engagement with the hexagonal opening in plunger 20*a*, motor trigger 62 is engaged to provide rotational motion to hex rod 30. This results in rotational motion of plunger 20*a* and plunger 20*a* moves longitudinally toward tip 8*a* causing barb 32*a* to exit sidewall openings 18*a*.

The present invention thus provides a tool that is uniquely adapted for installing fasteners of either type.

Various modes for carrying out the invention are contemplated as being within the scope of the following claims particularly pointing out and distinctly claiming the subject matter which is regarded as the invention.

I claim:

1. A tool for installing a threaded fastening device wherein the fastening device includes an internal channel extending substantially the entire length of the fastening device and terminating in an opening in the head of the fastening device; a barb assembly contained in the channel and sidewall openings in the tip of the fastening device to allow the barb to exit from the channel, the tool comprising:

a casing having a handle portion, a body portion and a tip portion, fastening device engaging means disposed adjacent said tip portion, rotating means operably connected to said fastening device engaging means for rotating said fastening device engaging means and in turn rotating the threaded fastening device to screw the fastening device into the materials to be joined, barb assembly engaging means extendable from said casing out through said tip portion for contacting the barb assembly and forcing the barb downwardly and out through the sidewall openings, and extension means connected to said barb asesmbly engaging means for extending said barb assembly engaging means from said casing and into contact with the barb assembly.

2. A tool for installing a threaded fastening device wherein the fastening device includes an internal channel extending substantially the entire length of the fastening device and terminating in an opening in the head of the fastening device; a barb assembly contained in the channel and sidewall openings in the tip of the fastening device to allow the barb to exit from the channel, the tool comprising:

a casing having a handle portion, a body portion and a tip portion, a fastening device engaging socket disposed adjacent said tip portion, said socket engagable with the head of the fastening device, rotating means disposed within said casing and operably connected to said socket for rotating said socket and in turn rotating the threaded fastening device to screw the fastening device into the materials to be joined, a barb assembly engaging rod disposed within said casing and movable between a retracted position and an extended position whereat said rod engages the barb assembly and forces the barb downwardly and out through the sidewall openings, a piston slidably mounted in said casing and connected to said rod, movement of said piston to its stroked position causing said rod to move to its extended position, biasing means disposed within said casing to bias said piston to its non-stroked position and in turn said rod to its retracted position.

3. The tool of claim 2 wherein said rod is slidably contained in said rotating means and engagable with said rotating means so that rotation of said rotating means results in rotation of said rod.

4. The tool of claim 1 wherein said fastening device engaging means comprises a socket engagable with the head of the fastening device.

5. The tool of claim 1 wherein said barb engaging means comprises a rod disposed within said casing and moveable between a retracted position and an extended position whereat said rod engages the barb assembly, said rod being slidably contained in said rotating means and engagable with said rotating means so that rotation of said rotating means results in rotation of said rod.

6. The tool of claim 5 wherein said extension means comprises a piston slidably mounted in said casing so that movement of said piston to its stroked position causes said rod to move to its extended position.

7. The tool of claim 6 further comprising biasing means disposed within said casing to bias said piston to its non-stroked position and in turn said rod to its retracted position.

8. The tool of claim 1 further comprising means for driving said rotating means and said extension means.

9. The tool of claim 8 further comprising a trigger mechanism for selectively operating said rotating means and said extension means.

10. A tool for installing a threaded fastening device wherein the fastening device includes an internal channel extending substantially the entire length of the fastening device and terminating in an opening in the head of the fastening device;

a rotatable plunger disposed in said channel and engaging the walls of said channel so that a rotation of said plunger results in longitudinal movement of said plunger toward said tip end; a flexible barb contained in the channel and connected to said plunger and sidewall openings in the tip of the fastening device whereby upon longitudinal movement of said plunger toward said tip end, said barb exits from said channel through said sidewall openings, the tool comprising:

a casing having a handle portion, a body portion and a tip portion, a fastening device engaging socket disposed adjacent said tip portion, said socket engagable with the head of the fastening device, rotating means disposed within said casing and operably connected to said socket for rotating said socket and in turn rotating the threaded fastening device to screw the fastening device into the materials to be joined, a plunger engaging rod disposed within said casing and slidably contained in said rotating means and operably engagable with said rotating means so that rotation of said rotating means results in rotation of said rod, said rod moveable between a retracted position and an extended position whereat said rod engages said plunger and rotation of said rod causes rotation of said plunger and resulting longitudinal movement of said plunger toward said tip end, a piston slidably mounted in said casing and connected to said rod, movement of said piston to its stroked position causing said rod to move to its extended position, biasing means disposed within said casing to bias said piston to its non-stroked position and in turn said rod to its retracted position.

* * * * *